United States Patent [19]

Elbert

[11] Patent Number: 4,668,903

[45] Date of Patent: May 26, 1987

[54] APPARATUS AND METHOD FOR A TEMPERATURE COMPENSATED REFERENCE VOLTAGE SUPPLY

[75] Inventor: Hubert F. Elbert, Tucson, Ariz.

[73] Assignee: Thaler Corporation, Tucson, Ariz.

[21] Appl. No.: 765,793

[22] Filed: Aug. 15, 1985

[51] Int. Cl.[4] ..... G05F 3/18; G05F 1/613

[52] U.S. Cl. ..... 323/231; 323/354; 323/369; 323/907

[58] Field of Search ..... 323/231, 297–298, 323/352–354, 365–367, 369, 907

[56] References Cited

U.S. PATENT DOCUMENTS

| | | | |
|---|---|---|---|
| 4,313,083 | 1/1982 | Gilbert et al. | 323/231 X |
| 4,315,209 | 2/1982 | Schmoock | 323/907 X |
| 4,562,400 | 12/1985 | Narasimhan | 323/907 X |

*Primary Examiner*—Peter S. Wong
*Attorney, Agent, or Firm*—William W. Holloway

[57] ABSTRACT

A voltage reference supply circuit is described that provides temperature compensation over a wide range of temperatures. The circuit includes a plurality of thermistor temperature dependent elements and these thermistor elements are utilized to compensate for the variation in the reference potential voltage of the Zener diode. The compensation is provided by determining the output voltage as a function of the circuit parameters and by varying pre-established resistive values in known ranges until the variations in the output voltage with temperature have been reduced below a predetermined value over the entire prescribed temperature range. Using this procedure, a variation in output voltage over the temperature range of −55° C. to +125° C. can be held within 50 parts per million.

17 Claims, 3 Drawing Figures

APPARATUS AND METHOD FOR A TEMPERATURE COMPENSATED REFERENCE VOLTAGE SUPPLY

BACKGROUND OF THE INVENTION

1. Field of the Invention

This invention relates generally to voltage reference supply units and, more particularly, to voltage reference supply units that are required to maintain an accurate voltage level over a wide range of temperatures.

2. Description of the Related Art

The stability of a voltage reference supply over a range of temperatures can provide the limiting factor for the accuracy of associated circuits. For example, in the military specification range (MILSPEC), the performance of an electronic device is specified over the temperature range of −55° to +125° C. In this temperature range, stability of the voltage level of the order of 500 parts per million can be typically obtained by providing compensating networks. More recently, some manufacturers provide voltage reference supply units with voltage level stability over this temperature range in the order of 300 parts per million using similar compensation techniques. These performance levels are typically achieved by using a Zener diode as a reference voltage source. The Zener diode is then coupled to temperature devices to compensate in a generally linear fashion for the temperature dependence of the voltage of the Zener diode.

However, the Zener diode can typically have non-linear components in the voltage level temperature dependence in this temperature range in addition to the linear component. It is the non-linear component of the output voltage level of the temperature dependence of the Zener diode which frequently provides the limit to the accuracy that can be achieved for the associated voltage reference supply.

A need has therefore been felt for a voltage reference supply that can operate in the temperature range of −55° C. to +125° C. with a variation in output voltage level of 50 parts per million or less over the entire temperature range.

SUMMARY OF THE INVENTION

It is therefore an object of the present invention to provide an improved voltage reference supply.

It is yet another object of the present invention to provide an improved voltage reference supply operating in the temperature range of −55° C. to +125° C.

It is still a further object of the present invention to provide a compensation network for the linear variation in the output voltage level of a voltage reference source as a function of temperature.

It is yet another object of the present invention to provide compensation for non-linear variations in output voltage level as a function of temperature of a voltage reference supply.

It is a more particular object of the present invention to provide a voltage reference supply with a variation in output voltage level with temperature over the temperature range of −55° C. to +125° C. of less than 50 parts per million.

The aforementioned and other objects are accomplished, according to the present invention, by providing temperature compensation for a voltage reference supply utilizing a Zener diode as a reference potential source. The output voltage of the voltage reference supply is determined by a plurality of amplifying elements and a multiplicity of resistive elements, including non-linear thermistor resistance elements. The elements are coupled to compensate for variations with temperature of the Zener diode voltage. Several of the resistive elements are trimmable, and the trimming operation for predetermined components provides adjustment in circuit characteristics to minimize the dependence of the output voltage on temperature. The resistive compensation elements of the voltage reference supply are first adjusted to provide a gross linear compensation of the temperature dependence of the output voltage. The compensation elements are then adjusted to provide a linear compensation in the high temperature region, a linear compensation in the low temperature region, and a second gross linear compensation of the resistive elements to produce an output voltage having a predetermined variation over the preselected temperature range. The result of the linear temperature compensation for limited temperature regions is to provide compensation for nonlinearities in the output voltage. If the adjustments to the resistive values do not provide a voltage variation with temperature falling within the preselected range, then the second portion of the compensation procedure can be repeated. This compensation procedure can be repeated until a proper voltage variation is found.

These and other features of the present invention will be understood upon reading of the following description along with the drawings.

FIGS. *2a* and *2b* are illustration of the underlying concept method of compensating for output voltage variations with temperature according to the present invention.

DESCRIPTION OF THE PREFERRED EMBODIMENT

Detailed Description of the Figures

Figure 1:
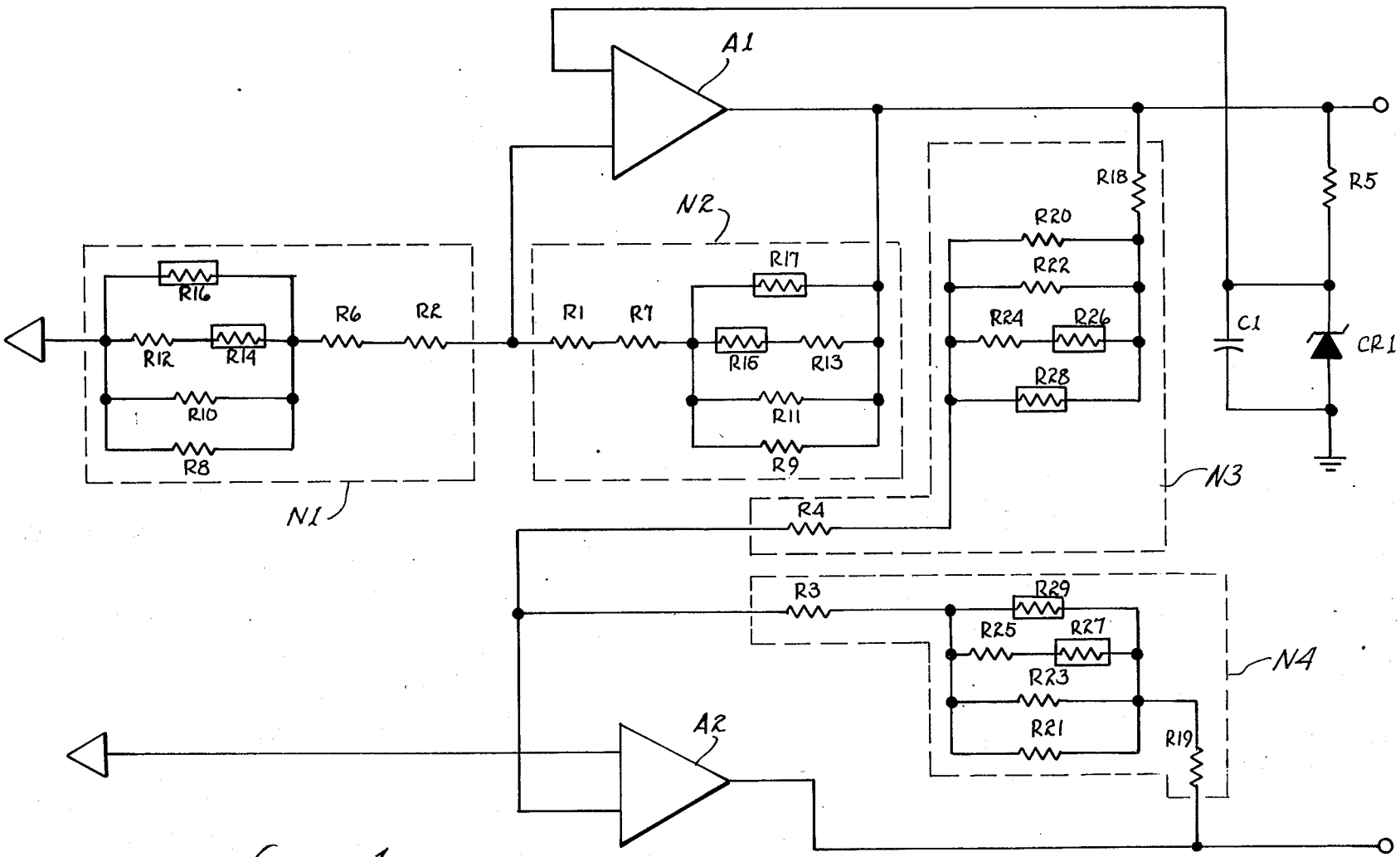
FIG. 1 is a schematic diagram of the voltage reference supply network according to the present invention.

Referring now to FIG. 1, a voltage reference source Zener diode CR1 has an anode terminal coupled to ground potential and a cathode terminal coupled to a first terminal of resistor R5 and to a first input terminal of amplifier A1. Capacitor C1 is coupled in parallel with Zener diode CR1. An output terminal of amplifier A1 is coupled to a first terminal of resistive network N2, to a first terminal of resistance network N3, to a second terminal of resistor R5, and to the positive output voltage terminal of the voltage reference supply. A second input terminal of operational amplifier A1 is coupled to a second terminal of resistance network N2 and to a second terminal of resistance network N1. A first terminal of resistance network N1 is coupled to the common or ground potential. The second terminal of resistance network N3 is coupled to a second input terminal of operational amplifier A2 and to a second terminal of resistive network N4. An output terminal of operational amplifier A2 is coupled to a first terminal of resistance network N4 and to the negative output voltage terminal of the reference voltage supply. A first input terminal of operational amplifier A2 is coupled to the ground potential. The voltage power terminals of operational amplifier A1 are coupled between a positive 15 volt potential and the ground potential, while the voltage power terminals of operational amplifier A2 are coupled between the positive 15 volt potential and a negative 15 volt potential. Both operational amplifier A1 and operation amplifier A2 have trim terminals for adjusting voltage levels in the amplifiers. With respect to resistive network N1, the first terminal of resistance network N1 is coupled through resistor R16 to a second terminal of resistor R6, through resistors R12 and R14 coupled in series to a second terminal of resistor R6, through resistor R10 to the second terminal of resistor R6 and through resistor R8 to the second terminal R6. The first terminal of resistor R6 is coupled through resistor R2 to the second terminal of resistance network N1. The first terminal of resistance network N2 is coupled through resistance R17 to a first terminal of resistor R7, through resistor 13 and resistor 15 coupled in series to a first terminal of resistor R7, through resistor R11 to a first terminal resistor R7, and through resistor R9 to a first terminal resistor R7. A second terminal of resistor R7 is coupled through resistor R1 to a second terminal of the resistance network N2. A first terminal of resistance network N3 is coupled to a first terminal of resistor R18. A second terminal of resistor R18 is coupled through resistor R20 to a first terminal resistor R4, through resistor R22 to a first terminal of resistor R4, through resistor 26 and resistor 24 coupled in series to a first terminal of resistor R4, and through resistor 28 to the first terminal of resistor R4. A second terminal of resistor R4 is coupled to the second terminal of resistance network N3. The first terminal of resistance network N4 is coupled to a first terminal of resistor R19. A second terminal of resistor R19 is coupled through resistor 21 to a first terminal of resistor R3, through resistor R23 to a first terminal of R3, through resistor R27 and R25 coupled in series to a first terminal of R3, and through resistor R29 to a first terminal of R3. A second terminal of R3 is coupled to the second terminal of resistor network N4. Resistors R14, R15, R16, R17, R26, R27, R28 and R29, are thermistor resistors having a known resistance as a function of temperature. Operational amplifiers A1 and A2 are commercially available amplifiers distributed by PMI with the designation OPO2.

Figure 2A:
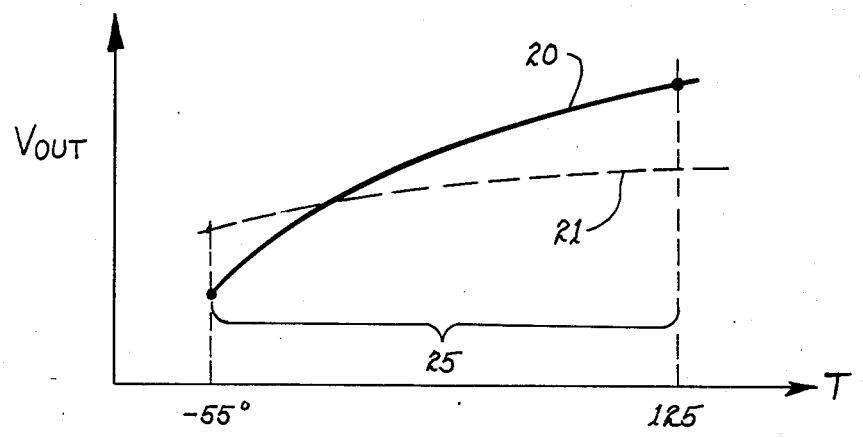
Figure 2B:
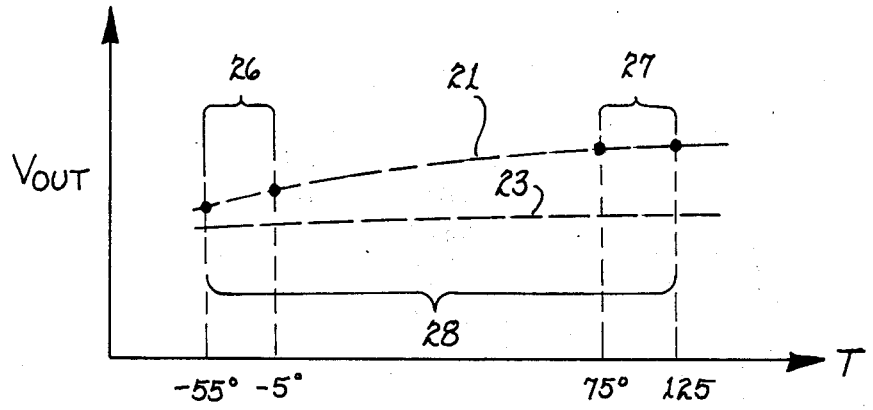

Referring next to FIG. 2, FIG. 2*a* shows an initial temperature dependence 20 of the output voltage, $V_{out}$, versus temperature for an arbitrary reference voltage supply. Relationship 21 shows an adjusted temperature variation after an initial linear compensation is made by adjusting selected resistance values. Referring next to FIG. 2*b*, the compensating adjustments are made for selected trimmable resistances made for the temperature range of 75° to 125° (27) and from −5° to −55° (26). In addition, a general slope and the temperature variation over the entire temperature range 28 is provided for the temperature dependence of the output voltage $V_{out}$. The relationship 23 is a representation of the results of the temperature compensation when the preliminary compensation of FIG. 2*a* and the three compensations shown for relationship 21 are combined.

OPERATION OF THE PREFERRED EMBODIMENT

The procedure and apparatus used in the temperature compensation can be understood in the following manner. The linear change in output voltage with temperature of the reference supply is reduced by trimming resistor R11 or R10 (depending on whether the slope is positive or negative) for the positive output voltage and similarly by trimming R22 and R23 for the negative output voltage. Next, resistors R12 or R13 are trimmed for the high temperature slope and R14 and R15 for the low temperature slope, the overall slope being adjusted by resistors R10 or R11.

A thermistor resistance value is defined by a variable $\beta$, beta being defined as a function of temperature as being equal to $$\beta = \frac{T2 \times T1}{T2 - T1} \ln\left(\frac{R2}{R1}\right)$$

where T2 and T1 are temperatures in degrees K. A typical value for beta can be −1600 for thermistor.

The method by which the values of the network can be determined is accomplished in the following manner. Through complicated but essentially unsophisticated circuit analysis techniques, the output voltage of the voltage reference supply is determined as a function of the resistances, the thermistor references and other circuit parameters. Using the function derived from the circuit analysis, the values of the trimmable resistors can be modified so that output voltage levels are adjusted, providing by this adjustment that the resulting difference in the output voltage at the two selected temperatures are minimized. Because the resistive effects may not be independent, this process of adjusting the values of the trimmable resistors can be iterated. By adjusting the difference in voltage levels over the temperature between the extreme values of the temperature range, a gross linear temperature compensation can be effected. By adjusting the temperature dependence in limited upper and limited lower temperature ranges, non-linear compensation can be provided. By appropriate selection of resistive values, the variation of the output voltage can be adjusted to be within predetermined limits, i.e. in the particular example, to over the temperature range by 50 ppm. The process described above provides the values for the resistance and can be iterated, if necessary, to insure that the temperature compensation is within the prescribed limits. Once these resistive values are determined, the associated resistors are physically trimmed, using well-known techniques, until the calculated values are implemented. Indeed, the present circuit provides that when a trimmable resistive element is "overtrimmed", i.e. an excess of conducting material has been removed from a resistive element, a backup resistor can be trimmed to compensate. For example, when R11 is overtrimmed, then R10 can be trimmed to provide the correct temperature compensation.

It will be clear that this technique depends on the use of a plurality of temperature dependent elements to compensate for the temperature dependence of the reference voltage elements. The temperature-dependent elements are coupled to provide compensation having a positive or a negative slope. The variable resistive elements are adjusted to establish the magnitude of the compensation.

The above description is included to illustrate the operation of the preferred embodiment and is not meant to limit the scope of the invention. The scope of the invention is to be limited only by the following claims. From the above description, many variations will be apparent to one skilled in the art that will yet be encompassed by the spirit and scope of the invention.

What is claimed is:

1. A temperature-compensated voltage reference supply comprising:

a voltage reference source;

a plurality of resistor means for providing an output voltage for said reference supply in response to said voltage reference source, each of said resistor means including;

at least one element having known temperature dependent properties;

a plurality of resistive elements, at least one of said resistive elements being a trimmable resistor, a first trimmable resistor associated with a first resistor means having a range of values selected for compensating for a reference supply output voltage temperature dependence at a first temperature, a second trimmable resistor associated with said first resistor means having a range of values selected for compensating said output voltage temperature dependence at a second temperature, and a third trimmable resistor associated with a second resistor means having a range of values selected for compensating said output voltage temperature dependence at a third temperature;

wherein said trimmable resistors are trimmed to provide an output voltage within a preselected voltage range at said first, said second, and said third temperatures.

2. The temperature-compensated voltage reference supply of claim 1 wherein said voltage reference source is a Zener diode.

3. The temperature-compensated voltage reference supply of claim 1 wherein said plurality of elements having known temperature properties are thermistors.

4. The temperature-compensated voltage reference supply of claim 1 wherein each of said resistor means includes a difference amplifier, an output voltage of a one of said difference amplifiers being compared with an output voltage of said reference voltage source, said trimmed trimmable resistors providing a predetermined relationship between said reference supply output voltage and said voltage reference source over a temperature range determined by said multiplicity of temperatures.

5. A method of supplying a temperature compensated reference voltage comprising the steps of:

providing a voltage source;

compensating for a linear temperature dependence of said reference source by compensating for said voltage source temperature dependence at a first and a second temperatures; and compensating for a non-linear temperature dependence of said reference source by compensating for said voltage source temperature dependence at third temperature and by compensating for said voltage source temperature dependence at a fourth temperature, wherein said third temperature is in a vicinity of the first temperature and said fourth temperature is in a vicinity of said second temperature.

6. A method of supplying a temperature-compensated reference voltage of claim 5 further comprising the steps of:

coupling a plurality of adjustable temperature-dependent circuits to said voltage reference source, and adjusting said temperature-dependent circuits to provide said compensating steps simultaneously at said first, second, third and fourth temperatures.

7. The method of supplying a temperature-compensated reference voltage of claim 5 wherein said compensating for non-linear temperature dependence step includes the step of compensating for linear temperature dependence of said reference voltage for a plurality of limited temperature ranges.

8. The method of supplying a temperature-compensated reference voltage supplying of claim 7 further including the steps of:

developing an equation for a circuit including said voltage reference source and said plurality of adjustable temperature dependent circuits, adjusting variable elements of said circuit equation until compensation of the temperature is achieved simultaneously at said first, said second said third and said fourth temperatures; and adjusting circuit parameters in accordance with said compensated circuit equation.

9. A temperature compensated voltage reference supplying comprising:

a reference voltage source having a temperature dependent output voltage;

a plurality of temperature dependent resist or means having a known temperature dependence, said temperature dependent resistor means including a plurality of adjustable resistors for adjusting a resistance of said resistor means; and a first and a second amplifying means for providing said reference supply output voltage between output terminals of said amplifying means, each of said amplifying means coupled to at least one of said resistor means and said reference voltage source, said resistor means compensating for said reference voltage source temperature dependence at a multiplicity of temperatures.

10. The temperature compensated voltage reference supply of claim 9 wherein said reference voltage source is a zener diode.

11. The temperature compensated voltage reference supply of claim 10 wherein each of said resistor means includes at least one thermistor.

12. The temperature compensated reference supply of claim 11, wherein said first amplifying means includes at least a first differential operational amplifier and said second amplifying means includes at least a second differential operational, an output terminal of said first and an output terminal of said second differential operational amplifier supplying a said reference supply output voltage;

wherein said reference supply is coupled to a first input terminal of said first differential operational amplifier;

wherein a first resistive means is coupled between said output terminal of said first differential operational amplifier and a second input terminal of said first differential operational amplifier, wherein a second resistive means is coupled between said second input terminal of said first differential operational amplifier and a ground potential;

wherein a third resistive means is coupled between said output terminal of said first differential operational amplifier and a second input terminal of said second differential operational amplifier; and wherein a fourth resistive means being coupled between said output terminal of said second differential operational amplifier and a second input terminal of said second differential operational amplifier.

13. The temperature compensated voltage reference supply of claim 12 wherein each of said resistor means includes a first resistor in series with a parallel resistor combination, said parallel resistor combination comprising four paths parallel to each other, a first parallel path comprising a second resistor, a second parallel path comprising a third resistor, a third parallel path comprising a first thermistor and a fourth resistor in series, and a fourth parallel path comprising a second thermistor.

14. The temperature compensated reference supply of claim 12 wherein at least one of said resistor means includes a trimmable resistor.

15. A temperature-compensated reference voltage comprising:

means for providing a voltage reference source;

means for compensating for a temperature dependence of said voltage reference source by providing a preselected output voltage at a multiplicity of temperatures in response to said voltage reference source.

16. The temperature-compensated reference voltage of claim 15 wherein said means for compensating for said temperature dependence a plurality of compensating means for providing a known compensating temperature dependence of said output voltage; and control means associated with each of said compensating means for determining a value of said output voltage.

17. A temperature-compensated voltage reference supply comprising:

a voltage reference source;

a plurality of amplifier means each receiving an input signal from said voltage reference source for supplying a reference supply output voltage;

a plurality of elements having known temperature dependent properties coupled to each of said amplifier means; and resistor means coupled to said each of said elements, said resistor means controlling said output voltage, said output voltage having a preselected value at a multiplicity of temperatures.

* * * * *